US010277976B2

(12) United States Patent
Oshima et al.

(10) Patent No.: US 10,277,976 B2
(45) Date of Patent: Apr. 30, 2019

(54) SPEAKER DEVICE HAVING DIAPHRAGM WITH FOLDED PORTION

(71) Applicants: Pioneer Corporation, Tokyo (JP); Tokoku Pioneer Corporation, Yamagata (JP)

(72) Inventors: Kenichi Oshima, Yamagata (JP); Koji Takayama, Yamagata (JP); Hirohito Ohno, Yamagata (JP); Hiroyuki Dohi, Yamagata (JP); Hayami Kondo, Yamagata (JP)

(73) Assignees: PIONEER CORPORATION, Tokyo (JP); TOHOKU PIONEER CORPORATION, Yamagata (JP)

( * ) Notice: Subject to any disclaimer, the term of this patent is extended or adjusted under 35 U.S.C. 154(b) by 0 days.

(21) Appl. No.: 15/534,288

(22) PCT Filed: Dec. 8, 2015

(86) PCT No.: PCT/JP2015/084394
§ 371 (c)(1),
(2) Date: Jun. 8, 2017

(87) PCT Pub. No.: WO2016/093226
PCT Pub. Date: Jun. 16, 2016

(65) Prior Publication Data

US 2017/0347184 A1 Nov. 30, 2017

(30) Foreign Application Priority Data

Dec. 8, 2014 (JP) ..... 2014-247600

(51) Int. Cl.
*H04R 1/24* (2006.01)
*H04R 7/12* (2006.01)
(Continued)

(52) U.S. Cl.
CPC ..... *H04R 1/24* (2013.01); *H04R 7/127* (2013.01); *H04R 7/18* (2013.01); *H04R 9/025* (2013.01);
(Continued)

(58) Field of Classification Search
CPC . H04R 1/24; H04R 9/06; H04R 9/025; H04R 31/006; H04R 7/127; H04R 7/18
See application file for complete search history.

(56) References Cited

U.S. PATENT DOCUMENTS

2007/0009133 A1* 1/2007 Gerkinsmeyer ..... H04R 7/127 381/398
2009/0214063 A1* 8/2009 Oclee-Brown ..... H04R 1/24 381/186

FOREIGN PATENT DOCUMENTS

JP 60-9298 1/1985
JP 2000-078689 3/2000
(Continued)

OTHER PUBLICATIONS

James B. Lansing Sound (JBL), Professional Series Model 2150 15 Composite Transducer, Posted online Jun. 13, 2001, www.jblpro.com/pub/obsolet/2150.pdf, pp. 1-2.*
(Continued)

*Primary Examiner* — Fan S Tsang
*Assistant Examiner* — Angelica M McKinney
(74) *Attorney, Agent, or Firm* — Young & Thompson

(57) ABSTRACT

Provided is a speaker device achieving thinning and cost reduction. The speaker device includes a first speaker unit and a second speaker unit. An outer peripheral side of the speaker unit is provided with a folded portion protruding to an opposite side of a sound emission direction P. A flat portion is provided inside the folded portion. An opening is provided inside the flat portion. A voice coil bobbin is
(Continued)

secured to the opening. A speaker unit is arranged in the voice coil bobbin. An external-magnet-type magnetic circuit is provided in the speaker unit. As a magnet of the magnetic circuit, a ferrite magnet having a large volume is used.

18 Claims, 5 Drawing Sheets

(51) Int. Cl.

| | |
|---|---|
| ***H04R 7/18*** | (2006.01) |
| ***H04R 9/02*** | (2006.01) |
| ***H04R 9/06*** | (2006.01) |
| ***H04R 9/04*** | (2006.01) |
| *H04R 7/14* | (2006.01) |
| *H04R 7/20* | (2006.01) |

(52) U.S. Cl.
CPC ..... *H04R 9/045* (2013.01); *H04R 9/06* (2013.01); *H04R 7/14* (2013.01); *H04R 7/20* (2013.01)

(56) References Cited

FOREIGN PATENT DOCUMENTS

| | | |
|---|---|---|
| JP | 2006-222792 | 8/2006 |
| WO | WO 2005/015950 | 2/2005 |

OTHER PUBLICATIONS

International Search Report/ PCT/JP2015/084394, dated Mar. 8, 2016.

JBL215 0, Audio no Sokuseki, [online] , 25 Mar. 6-8,10,11, 2010 (Mar. 25, 2010) , [retrieval date: Feb. 25, 2016 (Feb. 25, 2016)], Internet <URL:http://audio-heritage.jp/JBL/unit/2150.html>.

* cited by examiner

SPEAKER DEVICE HAVING DIAPHRAGM WITH FOLDED PORTION

TECHNICAL FIELD

This invention relates to a speaker device.

BACKGROUND ART

A compact and thin speaker device, for example, that is installed on a ceiling surface of an automobile is generally a one-way speaker covering a full range. Such a speaker device is disclosed in, for example, WO 2005/015950 A (Patent Literature 1). This conventional speaker device includes a folded diaphragm, thereby to enhance rigidity of the diaphragm and cover up to high frequencies.

CITATION LIST

Patent Literature

Patent Literature 1: WO 2005/015950 A

SUMMARY OF INVENTION

Technical Problem

In the conventional speaker device such as that in Patent Literature 1, it is necessary to adopt a magnetic circuit for forming a strong magnetic field by using a small magnet, to ensure a space for the folded diaphragm. In order to obtain a strong magnetic field with a small magnet like this, it is necessary to adopt a magnet having strong magnetic force, such as a neodymium magnet. However, a neodymium magnet is expensive, which causes a significant increase in cost.

Moreover, considering a vertical thickness when a sound emission direction is upward and its opposite side is downward, the speaker device in Patent Literature 1 has a following problem. Namely, a length is large between upper ends, which are an outer peripheral and a center part of a diaphragm, and a lower end, which is a bent portion of a folded portion, so that a configuration for a thinner speaker device is limited.

Therefore, an object of the invention is, as one example, to provide a speaker device achieving thinning and cost reduction, while being a two-way type speaker.

Solution to Problem

A speaker device according to a first aspect of the present invention includes a first speaker unit provided with an external-magnet-type magnetic circuit and a diaphragm having an opening, and a second speaker unit provided inside the opening. In the diaphragm, an outer peripheral side of the diaphragm is formed with a folded portion protruding to an opposite side of a sound emission direction.

DESCRIPTION OF EMBODIMENTS

Figure 1:
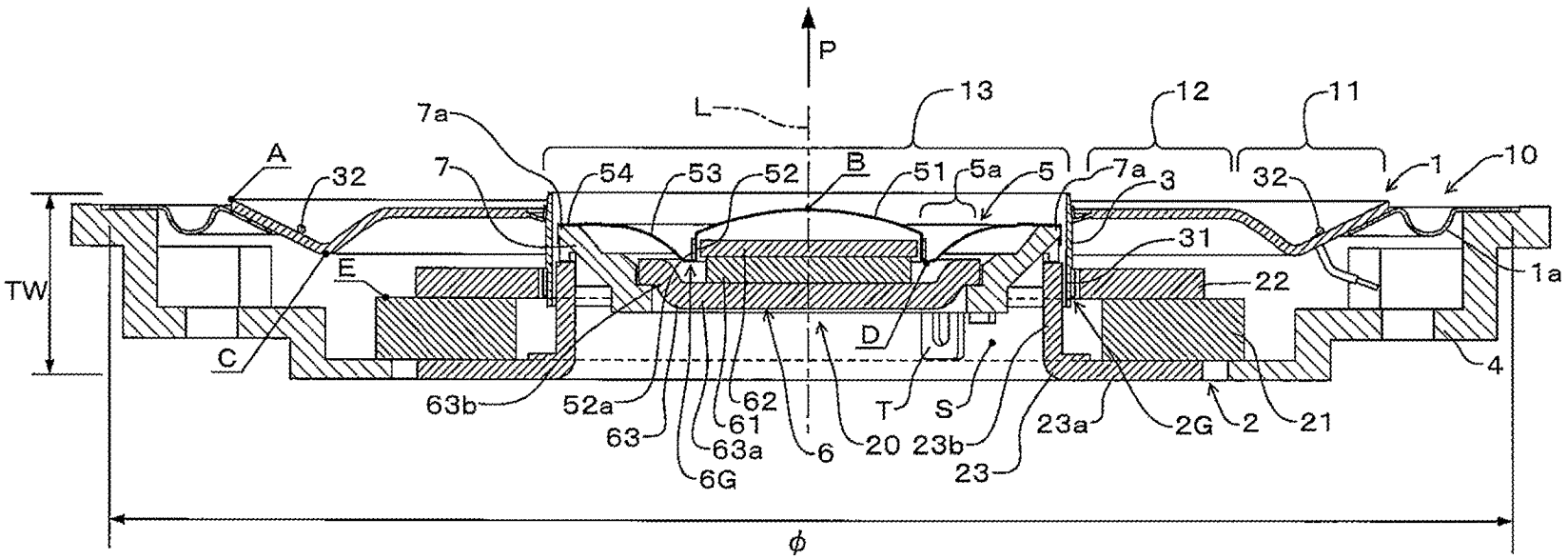
FIG. 1 is a longitudinal cross-sectional view of a speaker device of an example and a modification 1 of the present invention.

One embodiment of the present invention is described below. A speaker device according to the embodiment of the invention includes a first speaker unit provided with an external-magnet-type magnetic circuit and a diaphragm having an opening, and a second speaker unit provided inside the opening. In the diaphragm, an outer peripheral side of the diaphragm is formed with a folded portion protruding to an opposite side of a sound emission direction.

It is preferable that the diaphragm of the first speaker unit includes a flat portion formed on an inner peripheral side of the folded portion, and an outer diameter of the flat portion is smaller than an outer diameter of a magnet of a magnetic circuit.

It is preferable that the flat portion has a flat surface perpendicular to the sound emission direction of the first speaker unit.

It is preferable that the magnet is provided further inside than an apex of the folded portion.

It is preferable that the first speaker unit supports its diaphragm and includes a voice coil bobbin wound with a voice coil, and the second speaker unit is positioned further inside than the voice coil bobbin.

It is preferable that the magnetic circuit includes a yoke magnetically connected with the magnet, and the second speaker unit is positioned further inside than an inner periphery of the yoke of the first speaker unit.

It is preferable that the magnetic circuit includes a plate magnetically connected with a pole of the magnet, and an outer diameter of the plate is smaller than an outer diameter of the flat portion of the diaphragm.

In this case, it is preferable that the outer diameter of the plate is smaller than the outer diameter of the magnet.

It is preferable that the magnet of the first speaker unit has an annular shape, the magnet of the second speaker unit has a circular shape, and these magnets are coaxially arranged.

It is preferable that both the diaphragm of the first speaker unit and a diaphragm of the second speaker unit have a circular shape and are coaxial.

It is preferable that the magnet of the first speaker unit is a ferrite magnet.

It is preferable that a ratio TW/φ is $$0.1 \leq TW/\varphi \leq 0.2$$

in which TW/φ is the ratio of an outer diameter φ of the first speaker unit and a length TW from an upper end of the diaphragm of the first speaker unit to a lower end of the magnetic circuit of the first speaker unit.

It is preferable that an inner peripheral end of the external-magnet-type magnetic circuit of the first speaker unit is connected to an outer peripheral end of the second speaker unit.

In this case, it is preferable that a cylindrical portion of the yoke of the external-magnet-type magnetic circuit forms the inner peripheral end, the frame of the second speaker unit forms the outer peripheral end of the external-magnet-type magnetic circuit, and the cylindrical portion is connected to the outer peripheral end of the second speaker unit.

It is preferable that the external-magnet-type magnetic circuit of the first speaker unit includes the plate, the yoke, and an outer magnet arranged between the plate and the yoke, an internal-magnet-type magnetic circuit of the second speaker unit includes a plate, a yoke, and an inner magnet arranged between the plate and the yoke, a part of the external-magnet-type magnetic circuit and a part of the internal-magnet-type magnetic circuit are at a same height in the sound emission direction, magnetic poles of the outer magnet and the inner magnet on the plate side are same, and magnetic poles of the outer magnet and the inner magnet on the yoke side are same.

It is preferable that the external-magnet-type magnetic circuit of the first speaker unit includes the plate, the yoke, and the outer magnet arranged between the plate and the yoke, the internal-magnet-type magnetic circuit of the second speaker unit includes the plate, the yoke, and the inner magnet arranged between the plate and the yoke, a bottom part of the internal-magnet-type magnetic circuit is arranged further on the sound emission side than a bottom part of the external-magnet-type magnetic circuit, and a terminal part is arranged in a space surrounded by the bottom part of the internal-magnet-type magnetic circuit and the external-magnet-type magnetic circuit.

EXAMPLES

Figure 2:
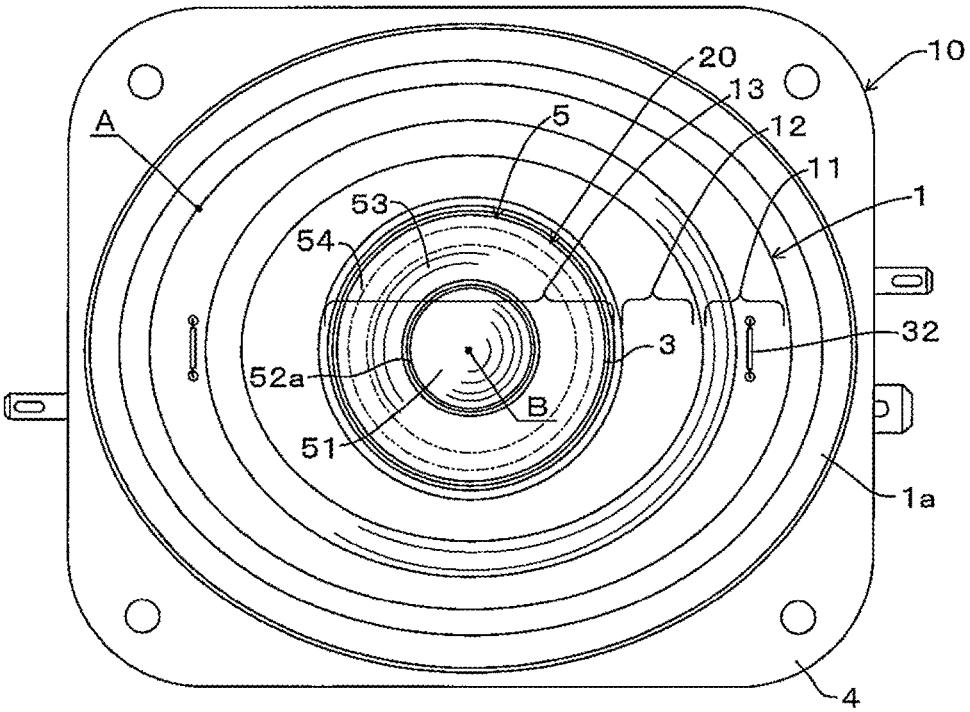
FIG. 2 is a surface plan view of the speaker device of the example.
Figure 3:
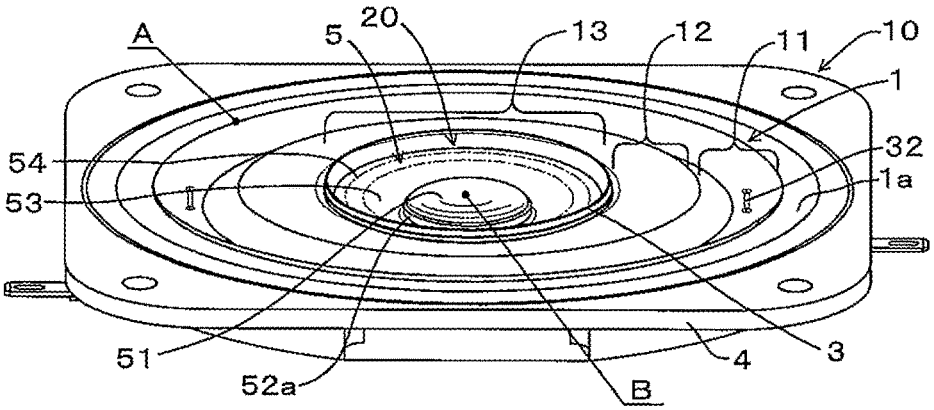
FIG. 3 is a surface perspective view of the speaker device of the example.
Figure 4:
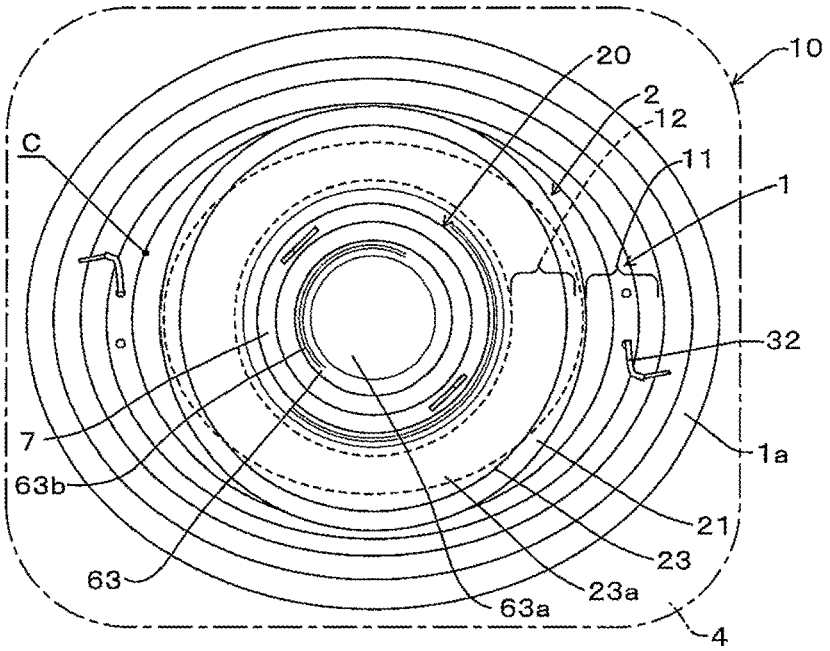
FIG. 4 is a back-side plan view of the speaker device of the example, with a frame removed.

FIG. 1 is a longitudinal cross-sectional view of a speaker device of an example and a modification 1 of the present invention, FIG. 2 is a surface plan view of the speaker device of the example, FIG. 3 is a surface perspective view of the speaker device of the example, and FIG. 4 is a back-side plan view of the speaker device of the example, with a frame removed. It should be noted that a concept of "upper and lower" in the following description corresponds to an upper and a lower in the view of FIG. 1.

The speaker device according to the example includes a first speaker unit 10 and a second speaker unit 20 that are coaxially arranged around an axis L as a central axis. In the speaker device of the example, the first speaker unit 10 functions as a speaker for low and intermediate frequencies, and the second speaker unit 20 functions as a tweeter for high frequencies. Moreover, sound emission directions of the first speaker unit 10 and the second speaker unit 20 are a direction of an arrow P indicated in FIG. 1. The speaker device of this example is a thin speaker device that is installed on an interior ceiling of an automobile, or the like.

The first speaker unit 10 is provided with a diaphragm 1, a magnetic circuit 2, a voice coil bobbin 3, and a frame 4. The diaphragm 1 has a slightly flattened ellipsoidal shape around the axis L as a central axis, and an outer peripheral end of the diaphragm 1 is supported by the frame 4 via an edge part 1*a*. The diaphragm 1 is, for example, formed of paper, resin, a metallic material or the like, and the diaphragm 1 is formed with a folded portion 11 that is bent in a V-shaped cross-section radially inside the edge part 1*a*. Additionally, a planar flat portion 12 is formed from an inner peripheral side of the folded portion 11 toward a center of the diaphragm 1. Furthermore, the diaphragm 1 is formed with a circular opening 13 around the axis L as a center, radially inside the flat portion 12.

The magnetic circuit 2 of the first speaker unit 10 has a magnet 21, a plate 22, and a yoke 23. The magnet 21 has an annular shape, and is a ferrite permanent magnet. It should be noted that the magnet 21 may also be, for example, a samarium-cobalt-based or an alnico-based permanent magnet. The plate 22 and the yoke 23 are formed of magnetic metal such as iron, and the plate 22 has an annular shape. The yoke 23 is formed by integrating an annular flange portion (bottom part) 23*a* that has a diameter substantially same as that of the plate 22, with a cylindrical portion 23*b* in a cylindrical shape that is erected from an inner periphery of the flange portion 23*a*. Then, the annular magnet 21 and the annular plate 22 are provided on an outer periphery of the cylindrical portion 23*b* of the yoke 23 with predetermined distances respectively from the cylindrical portion 23*b*, while the flange portion 23*a*, the magnet 21, and the plate 22 are superposed. This forms a magnetic gap 2G between an inner-peripheral-side end of the plate 22 and an upper end portion of the cylindrical portion 23*b* of the yoke 23.

The voice coil bobbin 3 has a cylindrical shape, and is secured to an inner peripheral edge of the circular opening 13 of the diaphragm 1. This allows the voice coil bobbin 3 to support the diaphragm 1. On a lower outer periphery of the voice coil bobbin 3, a voice coil 31 is wound. Moreover, the folded portion 11 is attached with a lead wire 32 for supplying a voice signal to the voice coil 31. The voice coil 31 (with the voice coil bobbin 3) is arranged within the magnetic gap 2G of the magnetic circuit 2. When the voice signal is input to the voice coil 31, the voice coil 31 and the voice coil bobbin 3 vibrate in a direction of the axis L, to vibrate the diaphragm 1. This makes the sound emission direction P of the first speaker unit 10 to be an upward direction parallel to the axis L.

The second speaker unit 20 is provided with a diaphragm 5, a magnetic circuit 6, and a frame 7. The diaphragm 5 is formed of a metallic material, and has a rotationally symmetrical shape around the axis L as a rotational axis. Additionally, the diaphragm 5 has a domed diaphragm 51, a voice coil bobbin 52, a conical diaphragm 53, and an outer peripheral end 54, in which the domed diaphragm 51, the voice coil bobbin 52, the conical diaphragm 53, and the outer peripheral end 54 are integrally formed. Then, the diaphragm 5 is supported by the frame 7 at the outer peripheral end 54.

The domed diaphragm 51 is formed in a convex shape at a center part of the diaphragm 5, and an apex part at a center of the domed diaphragm 51 is formed higher than the outer peripheral end 54. This shape provides wide-angle directional characteristics. Moreover, the domed diaphragm 51 is vibratably supported along the axis L direction (driving direction), at a prescribed position on the magnetic circuit 6, by the voice coil bobbin 52, the conical diaphragm 53, and the outer peripheral end 54.

The magnetic circuit 6 of the second speaker unit 20 has a magnet 61, a plate 62, and a yoke 63. The magnet 61 has a disk shape, and is a ferrite permanent magnet, for example. It should be noted that the magnet 61 may also be, for example, a samarium-cobalt-based, an alnico-based, or a neodymium-base permanent magnet. The plate 62 and the yoke 63 are formed of magnetic metal, such as iron, and the plate 62 has a disk shape having a slightly larger diameter than that of the magnet 61. The yoke 63 is formed by integrating a disk-shaped disk portion (bottom part) 63*a* having a larger diameter than that of the magnet 61, with a curved portion 63*b* curved from the disk portion 63*a* to the plate 62 side. Then, the magnet 61 is interposed between the disk portion 63*a* and the plate 62, while the yoke 63, the magnet 61, and the plate 62 are superposed. This forms a magnetic gap 6G between an outer peripheral end of the plate 62 and an inner peripheral surface of the curved portion 63*b* of the yoke 63.

The voice coil bobbin 52 of the diaphragm 5 has a cylindrical shape, and a voice coil 52*a* is wound on an outer periphery of the voice coil bobbin 52. The voice coil 52*a* (with the voice coil bobbin 52) is arranged within the magnetic gap 6G of the magnetic circuit 6. When the voice signal is input to the voice coil 52*a*, the voice coil 52*a* and the voice coil bobbin 52 vibrate in a direction of the axis L, to vibrate the diaphragm 5. This makes the sound emission direction P of the second speaker unit 20 to be an upward direction parallel to the axis L. The voice coil 52*a* may also be secured to the voice coil bobbin 52 of the diaphragm by an adhesive or the like.

In the figures, "A" is an upper end of the diaphragm 1, "B" is an upper end of the diaphragm 5, "C" is a lower end of the diaphragm 1, "D" is a lower end of the diaphragm 5, and "E" is an upper end of the magnet 21. Although each of the upper ends and the lower ends are shown as a line in the FIGS. 2 to 4, the upper end A, the upper end B, the lower end C, and the lower end D are optional points on the lines.

The speaker device of the example includes the first speaker unit 10 provided with the external-magnet-type magnetic circuit 2 and the diaphragm 1 having the opening 13, and the second speaker unit 20 provided radially inside the opening 13. In the diaphragm 1 of the first speaker unit 10, the outer peripheral side of the diaphragm 1 is formed with the folded portion 11 protruding to an opposite side of the sound emission direction P. Since the folded portion 11 has a shape (V-shaped cross section) protruding to the opposite side of the sound emission direction P, a cross-sectional secondary moment on a surface including the axis L is large, so that the rigidity can be secured.

As shown in FIG. 1, an outer diameter of the flat portion 12 of the diaphragm 1 is smaller than an outer diameter of the magnet 21 of the magnetic circuit 2. Moreover, the flat portion 12 has a flat surface perpendicular to the sound emission direction P of the first speaker unit 10. Therefore, a thickness of the diaphragm 1 in the sound emission direction can be thinned, which makes possible to thin a thickness of the first speaker unit 10 itself. Furthermore, since the folded portion 11 outside the flat portion 12 protrudes to the opposite side of the sound emission direction P further outside than the outer diameter of the magnet 21, an inner space under the flat portion 12 can be widely taken, an external-magnet-type can be adopted for the magnetic circuit 2, and a ferrite magnet having a relatively large volume may be adopted as its magnet 21. Therefore, a cost can be reduced while a sufficient driving force is obtained.

The second speaker unit 20 is positioned radially inside the voice coil bobbin 3 of the first speaker unit 10. Therefore, the thickness of the speaker device can be thinned. The first speaker unit 10 includes the plate 22 magnetically connected with a pole of the magnet 21, and an outer diameter of the plate 22 is smaller than the outer diameter of the flat portion 12 of the diaphragm 1. Additionally, the outer diameter of the plate 22 is smaller than the outer diameter of the magnet 21. Therefore, a thickness of the diaphragm 1 in the sound emission direction can be thinned, which makes possible to thin a thickness of the first speaker unit 10 itself.

The magnet 21 of the magnetic circuit 2 of the first speaker unit 10 has an annular shape, and the magnet 61 of the magnetic circuit 6 of the second speaker unit 20 has a circular shape. These magnets 21 and 61 are coaxially arranged.

Additionally, the speaker device of the example includes the first speaker unit 10 having the first diaphragm 1 supported by the voice coil bobbin 3, and the second speaker unit 20 having the second diaphragm 5 provided radially inside the voice coil bobbin 3 and having the sound emission direction P that substantially coincides with that of the first speaker unit 10. When the sound emission direction P is upward and its opposite direction is downward, the position of the upper end A of the first diaphragm 1 is substantially equal to the position of the upper end B of the second diaphragm 5, as shown in FIG. 1. Therefore, phases of a sound wave radiated from the first diaphragm 1 and a sound wave radiated from the second diaphragm 5 are equal, which provides excellent acoustic characteristics.

Additionally, as shown in FIG. 1, the position of the lower end C of the first diaphragm 1 of the first speaker unit 10 is substantially equal to the position of the lower end D of the second diaphragm 5 of the second speaker unit 20. Moreover, a length from the upper end A to the lower end C of the first diaphragm 1 is substantially equal to a length from the upper end B to the lower end D of the second diaphragm 5. Therefore, the thickness of the speaker device can be thinned.

Additionally, the second speaker unit 20 includes the magnetic circuit 6 including the magnet 61, and the magnet 61 is provided between an upper end and a lower end of the voice coil bobbin 3 of the first speaker unit 10. Therefore, the thickness of the speaker device can be thinned.

The first diaphragm 1 of the first speaker unit 10 includes, on its inner peripheral side, the flat portion 12 that has the flat surface perpendicular to the sound emission direction P, and this flat portion 12 is substantially equal to the position of the upper end B of the second diaphragm 5 of the second speaker unit 20.

Furthermore, the first diaphragm 1 includes, on its outer peripheral side, the folded portion 11 protruding to the opposite side of the sound emission direction P, and the position of the lower end C of the folded portion 11 is substantially equal to the position of the lower end D of the second diaphragm 5.

Furthermore, the first speaker unit 10 includes the magnetic circuit 2 including the magnet 21, and the lower end C of the folded portion 11 of the first diaphragm 1 is positioned upper than the upper end E of the magnet 21 of the first speaker unit 10.

Furthermore, the second diaphragm 5 includes a folded portion 5*a* that is formed protruding to the opposite side of the sound emission direction P, by the voice coil bobbin 52 and the conical diaphragm 53. Then, the position of the lower end C of the folded portion 11 of the first diaphragm 1 is substantially equal to the position of the lower end D of the folded portion 5*a* of the second diaphragm 5.

When the first diaphragm 1 vibrates to a sound emission side (sound emission direction P side), the position of the upper end A of the first diaphragm 1 becomes upper than the position of the upper end B of the second diaphragm 5, and when the first diaphragm 1 vibrates to an opposite side of the sound emission side (opposite side of the sound emission direction P), the position of the upper end A of the first diaphragm 1 becomes lower than the position of the upper end B of the second diaphragm 5.

Moreover, as shown in FIG. 1, a vertical thickness of the magnet 21 of the magnetic circuit 2 of the first speaker unit 10 is larger than the length from the upper end A to the lower end C of the first diaphragm 1. In other words, there is used the magnet 21 having a large volume for the thin diaphragm 1.

Figure 5:
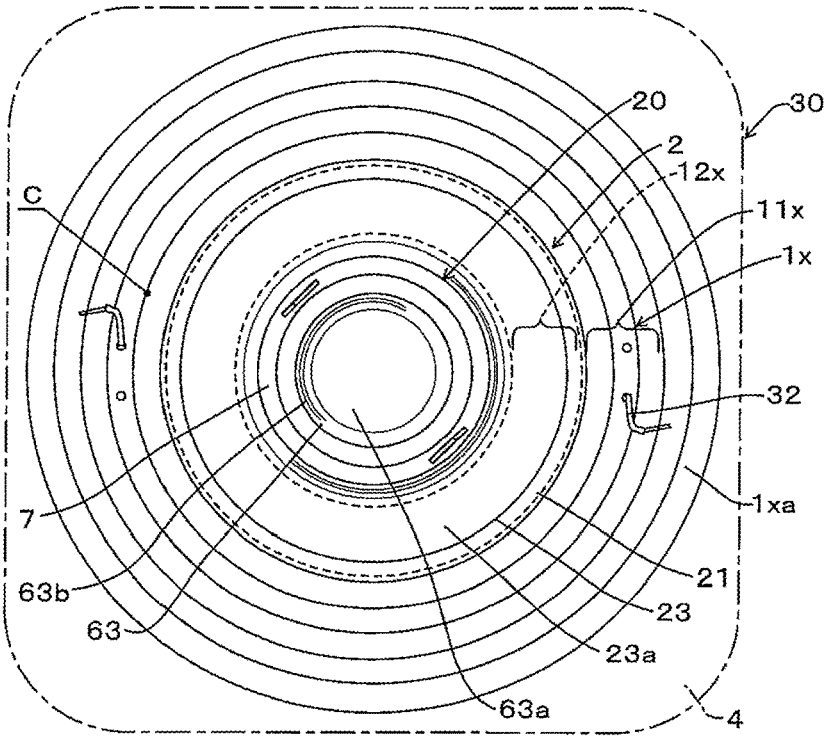
FIG. 5 is a back-side plan view of a speaker device of the modification 1 of the example of the invention.

Although the above example illustrates an example in which the diaphragm 1 of the first speaker unit 10 has the ellipsoidal shape, the shape of the diaphragm may also be a circular shape (complete circle) such as the modification 1 in FIG. 5. It should be noted that, in the following modifications 1 and 2, like reference numerals refer to the like elements in the example. Moreover, since structures and effects of the like elements are the same as those of the example, repeated descriptions are omitted.

A speaker unit 30 in the modification 1 shown in FIG. 5 has a circular diaphragm 1*x*. A longitudinal cross-sectional view of the speaker device in the modification 1 is same as FIG. 1. The diaphragm 1*x* is, for example, formed of paper, resin, a metallic material or the like, and the diaphragm 1*x* is formed with a folded portion 11*x* that is bent in a V-shaped cross-section radially inside an edge part 1*xa*. Additionally, a planar flat portion 12*x* is formed from an inner peripheral side of the folded portion 11*x* toward a center of the diaphragm 1*x*. Moreover, an opening 13 same as that of the example is formed radially inside the flat portion 12*x*. All of the edge part 1*xa*, the folded portion 11*x* and a lower end C thereof, and the flat portion 12*x* have a complete circle shape. A magnetic circuit 2 and a voice coil bobbin 3 are the same as those of the example. In this modification 1, a circle formed of the lower end C of the folded portion 11*x* has a larger diameter than that of a magnet 21 of the magnetic circuit 2.

Thus, the magnet 21 of the magnetic circuit 2 of a first speaker unit 30 is provided radially further inside than the lower end C of the folded portion 11*x* of the diaphragm 1*x*, which eliminates consideration of interference between the magnet 21 and the folded portion 11*x*, and can thin the thickness of the speaker device.

Additionally, both the diaphragm 1*x* of the first speaker unit 30 and the diaphragm 5 of a second speaker unit 20 have a circular shape and are coaxial.

Figure 6:
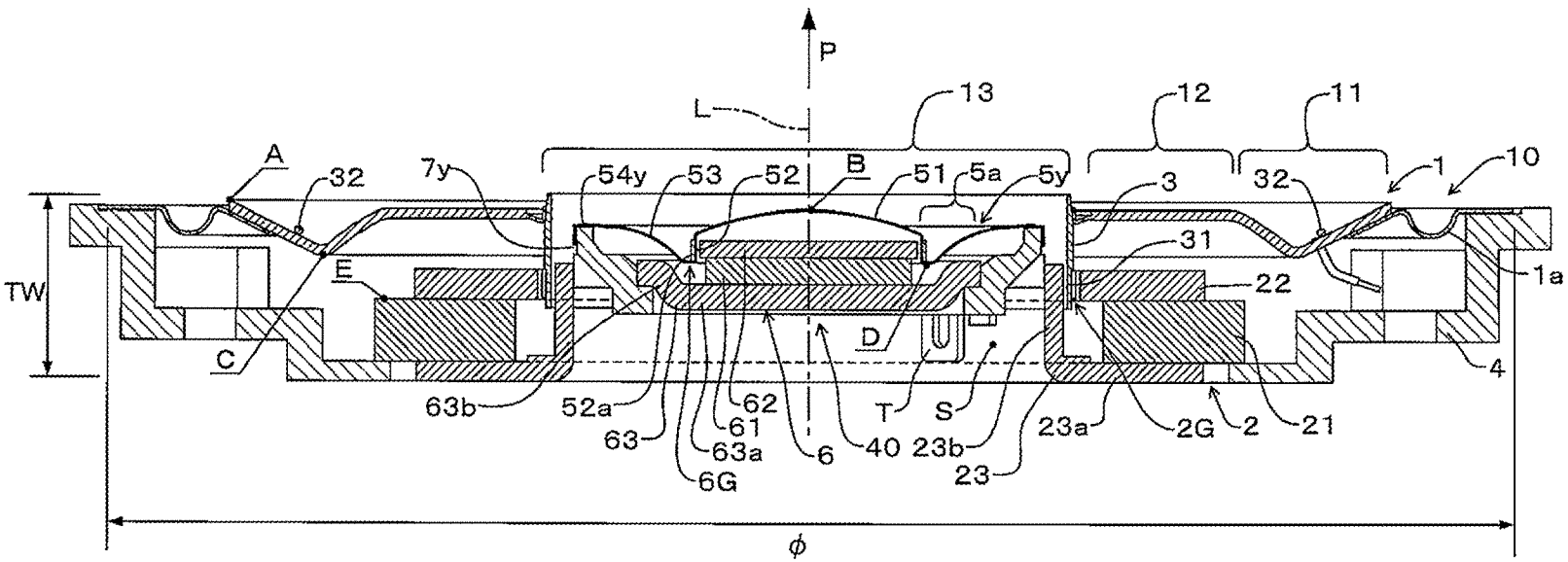
FIG. 6 is a longitudinal cross-sectional view of a speaker device of a modification 2 of the example of the invention.

Although the frame 7 of the second speaker unit 20 is engaged with the end of the cylindrical portion 23*b* of the yoke 23 of the magnetic circuit 2 of the first speaker unit 10 in the example above and the modification 1, a relation between the second speaker unit and the yoke 23 of the magnetic circuit 2 may also be such as that of the modification 2 in FIG. 6.

In the modification 2 shown this FIG. 6, a second speaker unit 40 is provided with a magnetic circuit 6 same as that of the example, and provided with a diaphragm 5*y* having a smaller diameter than that of the diaphragm 5, and a frame 7*y* having a smaller diameter than that of the frame 7. The diaphragm 5*y* has a domed diaphragm 51, a voice coil bobbin 52, and a conical diaphragm 53, and has an outer peripheral end 54*y* having a smaller diameter than that of the outer peripheral end 54 of the example. The diaphragm 5*y* is supported by the frame 7*y* at the outer peripheral end 54*y*. Therefore, the second speaker unit 40 in this modification 2 has a smaller outer diameter than that of the second speaker unit 20 in the example, and the second speaker unit 40 is fitted into a cylindrical portion 23*b* of a yoke 23 of a first speaker unit 10. Thus, in the modification 2, a magnetic circuit 2 in the first speaker unit 10 includes the yoke 23 magnetically connected with a magnet 21, and the second speaker unit 40 is positioned radially further inside than an inner peripheral of the yoke 23 of the first speaker unit 10.

As shown in FIGS. 1 and 6, in the speaker devices of the example and the modifications 1 and 2, the length TW from the upper end A of the diaphragm 1 of the first speaker unit 10 to the lower end (lower end of the yoke 23) of the magnetic circuit 2 of the first speaker unit 10 is about 10 mm. Additionally, the outer diameter φ of the first speaker unit 10 is about 80 mm.

Thus, the ratio TW/φ is $$0.1 \leq TW/\varphi \leq 0.2$$

in which TW/φ is the ratio of the length TW and the outer diameter φ.

It should be noted that, while the diaphragms 1 and 1*x*, and diaphragms 5 and 5*y* are, for example, formed of paper, resin, a metallic material or the like in the example and the modifications 1 and 2 above, aluminum, titanium, duralumin, beryllium, magnesium alloy or the like, for example, may be adopted as the metallic material.

Thus, in the example and the modification 1, an inner peripheral end of the external-magnet-type magnetic circuit 2 of the first speaker unit 10 is connected to an outer peripheral end of the second speaker unit 20. In other words, the cylindrical portion 23*b* of the yoke 23 of the external-magnet-type magnetic circuit 2 of the first speaker unit 10 forms the inner peripheral end of the external-magnet-type magnetic circuit 2, and an outer peripheral end 7*a* of the frame 7 of the second speaker unit 20 forms the outer peripheral end of the second speaker unit 20. Then, the cylindrical portion 23*b* is connected to the outer peripheral end 7*a* of the frame 7 of the second speaker unit 20. This eliminates the necessity of a fading plug or the like, which has been conventionally used for a so-called coaxial speaker, and can achieve weight reduction.

Moreover, in the example and the modifications 1 and 2, the external-magnet-type magnetic circuit 2 of the first speaker unit 10 includes the plate 22, the yoke 23, and the magnet 21 (outer magnet) arranged between the plate 22 and the yoke 23. Furthermore, the magnetic circuit 6 of the second speaker unit 20 (40) includes the plate 62, the yoke 63, and the magnet 61 (inner magnet) arranged between the plate 62 and the yoke 63, and the magnetic circuit 6 constitutes an internal-magnet-type magnetic circuit. Then, a part of the external-magnet-type magnetic circuit 2 and a part of the internal-magnet-type magnetic circuit 6 are at a same height in the sound emission direction P. More particularly, the plate 22 and a part of the cylindrical portion 23*b* of the yoke 23 of the external-magnet-type magnetic circuit 2 are at a same height with respect to a part of the magnet 61 and a part of the yoke 63 of the internal-magnet-type magnetic circuit 6.

Figure 7:
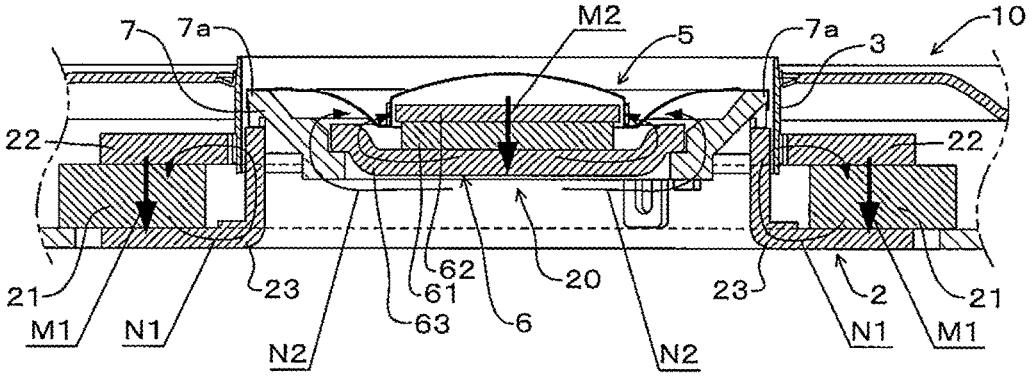
FIG. 7 is a view illustrating directions of magnetic poles of magnets and an example of flows of magnetic fluxes in the example of the invention.

FIG. 7 is a view illustrating directions of magnetic poles of the magnets 61 and 21, and an example of flows of magnetic fluxes, in which only main reference numerals are given.

Although the FIG. 7 illustrates cases of the example and the modification 1, a case of the modification 2 is the same. In addition to the configuration above, magnetic poles of the magnet 61 (outer magnet) and the magnet 21 (inner magnet) on the plates 62 and 22 side are same, and the magnetic poles of the magnet 61 (outer magnet) and the magnet 21 (inner magnet) on the yokes 63 and 23 side are same. More particularly, the magnetic pole direction of the magnet 61 indicated by the arrow M1 in FIG. 7 and the magnetic pole direction of the magnet 21 indicated by the arrow M2 in FIG. 7 are in a same direction. It should be noted that the arrow N1 illustrates an example of a flow of magnetic flux of the magnet 61, and the allow N2 illustrates an example of a flow of magnetic flux of the magnet 21.

Therefore, while it is difficult to arrange the external-magnet-type magnetic circuit and the internal-magnet-type magnetic circuit close to each other due to repulsion therebetween if the directions of the magnetic poles of the outer magnet and the inner magnet are made to be opposite, the example and the modifications 1 and 2 make it possible to arrange the external-magnet-type magnetic circuit 2 and the internal-magnet-type magnetic circuit 6 close to each other. Moreover, high efficiency of the magnetic circuits 2 and 6 can be achieved.

Furthermore, as shown in FIGS. 1 and 6, a bottom part (bottom part 63*a* of the yoke 63) of the internal-magnet-type magnetic circuit 6 of the second speaker unit 20 (40) is arranged further on the sound emission side (sound emission direction P side) than a bottom part (bottom part 23*a* of the yoke 23) of the external-magnet-type magnetic circuit 2 of the first speaker unit 10, and a terminal part T is arranged in a space S surrounded by the bottom part of the internal-magnet-type magnetic circuit 6 and the external-magnet-type magnetic circuit 2. This can reduce a space for arranging the terminal part T and can thin the speaker device.

Although the embodiment of the invention has been described above in detail with reference to the drawings, a specific configuration is not limited to the embodiment, and a change of a design or the like without departing from the subject matter of the invention is included in the invention. Contents of the examples illustrated in each of the figures above can be combined with each other as long as there is no particular inconsistency or problem in its purpose, configuration, and the like. Moreover, each of the contents of each of the figures can be an independent embodiment, and the embodiment of the invention is not limited to one embodiment that is a combination of the figures. For example, the first speaker unit 10 and the second speaker unit have coaxial axes, or different axes. Shapes of the diaphragm and the magnetic circuit are not limited to a circle or ellipse, and the shapes may also be polygonal.

REFERENCE SIGNS LIST

10 first speaker unit
1 diaphragm (first diaphragm)
11 folded portion
12 flat portion
13 opening
2 magnetic circuit
21 magnet
22 plate
23 yoke
23*a* flange portion (bottom part)
23*b* cylindrical portion
2G magnetic gap
3 voice coil bobbin
31 voice coil
4 frame
20 second speaker unit
5 diaphragm (second diaphragm)
51 domed diaphragm
52 voice coil bobbin
53 conical diaphragm
54 outer peripheral end
6 magnetic circuit
6G magnetic gap
61 magnet
62 plate
63 yoke
63*a* disk portion (bottom part)
63*b* curved portion
7 frame
30 first speaker unit
1*x* diaphragm
11*x* folded portion
12*x* flat portion
40 second speaker unit
5*y* diaphragm (second diaphragm)
7*y* frame
P sound emission direction
A upper end of first diaphragm
B upper end of second diaphragm
C lower end of first diaphragm
D lower end of second diaphragm
E upper end of magnet
L axis

The invention claimed is:

1. A speaker device comprising:

a first speaker unit provided with an external-magnet-type magnetic circuit and a diaphragm having an opening; and a second speaker unit provided inside the opening, wherein, in the diaphragm, an outer peripheral side of the diaphragm is formed with a folded portion protruding to an opposite side of a sound emission direction, and the diaphragm comprises a flat portion formed on an inner peripheral side of the folded portion, an outer diameter of the flat portion being smaller than an outer diameter of a magnet of the external-magnet-type magnetic circuit.

2. The speaker device according to claim 1, wherein the flat portion has a flat surface perpendicular to the sound emission direction of the first speaker unit.

3. The speaker device according to claim 1, wherein the magnet is provided further inside than an apex of the folded portion.

4. The speaker device according to claim 1, wherein the first speaker unit supports the diaphragm and comprises a voice coil bobbin wound with a voice coil, and the second speaker unit is positioned further inside than the voice coil bobbin.

5. The speaker device according to claim 1, wherein the magnetic circuit comprises a yoke magnetically connected with the magnet, and the second speaker unit is positioned further inside than an inner periphery of the yoke.

6. The speaker device according to claim 1, wherein the magnetic circuit comprises a plate magnetically connected with a pole of the magnet, and an outer diameter of the plate is smaller than the outer diameter of the flat portion.

7. The speaker device according to claim 6, wherein the outer diameter of the plate is smaller than the outer diameter of the magnet.

8. The speaker device according to claim 1, wherein the magnet of the first speaker unit has an annular shape, a magnet of the second speaker unit has a circular shape, and the magnets are coaxially arranged.

9. The speaker device according to claim 1, wherein both the diaphragm of the first speaker unit and a diaphragm of the second speaker unit have a circular shape and are coaxial.

10. The speaker device according to claim 1, wherein the magnet of the first speaker unit is a ferrite magnet.

11. The speaker device according to claim 1, wherein a ratio TW/φ is $$0.1 \leq TW/\varphi \leq 0.2$$

wherein TW/φ is the ratio of an outer diameter φ of the first speaker unit and a length TW from an upper end of the diaphragm of the first speaker unit to a lower end of the magnetic circuit of the first speaker unit.

12. The speaker device according to claim 1, wherein an inner peripheral end of the external-magnet-type magnetic circuit of the first speaker unit is connected to an outer peripheral end of the second speaker unit.

13. The speaker device according to claim 12, wherein a cylindrical portion of a yoke of the external-magnet-type magnetic circuit forms the inner peripheral end, a frame of the second speaker unit forms an outer peripheral end of the external-magnet-type magnetic circuit, and the cylindrical portion is connected to the outer peripheral end of the second speaker unit.

14. The speaker device according to claim 1, wherein the external-magnet-type magnetic circuit of the first speaker unit comprises a plate, a yoke, and an outer magnet arranged between the plate and the yoke, an internal-magnet-type magnetic circuit of the second speaker unit comprises a plate, a yoke, and an inner magnet arranged between the plate and the yoke, a part of the external-magnet-type magnetic circuit and a part of the internal-magnet-type magnetic circuit are at a same height in the sound emission direction, magnetic poles of the outer magnet and the inner magnet on the plate side are same, and magnetic poles of the outer magnet and the inner magnet on the yoke side are same.

15. The speaker device according to claim 1, wherein the external-magnet-type magnetic circuit of the first speaker unit comprises a plate, a yoke, and an outer magnet arranged between the plate and the yoke, an internal-magnet-type magnetic circuit of the second speaker unit comprises a plate, a yoke, and an inner magnet arranged between the plate and the yoke, a bottom part of the internal-magnet-type magnetic circuit is arranged further on a sound emission side than a bottom part of the external-magnet-type magnetic circuit, and a terminal part is arranged in a space surrounded by the bottom part of the internal-magnet-type magnetic circuit and the external-magnet-type magnetic circuit.

16. A speaker device comprising:

a first speaker unit provided with an external-magnet-type magnetic circuit and a diaphragm having an opening; and a second speaker unit provided inside the opening, wherein, in the diaphragm, an outer peripheral side of the diaphragm is formed with a folded portion protruding to an opposite side of a sound emission direction, wherein a ratio TW/φ is $$0.1 \leq TW/\varphi \leq 0.2$$

wherein TW/φ is the ratio of an outer diameter φ of the first speaker unit and a length TW from an upper end of the diaphragm of the first speaker unit to a lower end of the magnetic circuit of the first speaker unit.

17. The speaker device according to claim 16, wherein the flat portion has a flat surface perpendicular to the sound emission direction of the first speaker unit.

18. The speaker device according to claim 16, wherein the magnet is provided further inside than an apex of the folded portion.

* * * * *